US005769740A

United States Patent [19]

Colangelo

[11] Patent Number: 5,769,740

[45] Date of Patent: Jun. 23, 1998

[54] GOLFING ACESSORY APPARATUS

[75] Inventor: David Colangelo, St. Petersburg, Fla.

[73] Assignee: Sun Time Enterprises, Inc., Clearwater, Fla.

[21] Appl. No.: 889,923

[22] Filed: Jul. 10, 1997

[51] Int. Cl.[6] ..... A63B 57/00

[52] U.S. Cl. ..... 473/408; 473/406; 473/283

[58] Field of Search ..... 473/406, 408, 473/409, 405, 407, 282, 283, 285, 286

[56] References Cited

U.S. PATENT DOCUMENTS

| | | | |
|---|---|---|---|
| D. 318,625 | 7/1991 | Stowell | 473/408 |
| 4,960,278 | 10/1990 | Hainey | 473/408 |
| 5,160,134 | 11/1992 | McDonald | 473/408 |
| 5,224,700 | 7/1993 | Rosen | 473/408 |
| 5,356,133 | 10/1994 | Bellagamba | 473/406 |
| 5,419,551 | 5/1995 | Hoyt et al. | 473/408 |
| 5,529,299 | 6/1996 | Bellagamba | 473/408 |

*Primary Examiner*—Steven B. Wong
*Attorney, Agent, or Firm*—William M. Hobby, III

[57] ABSTRACT

A golf club tool, timepiece, and scoring apparatus has an elongated body having a pair of prongs on one end thereof shaped to form a divot tool and a pair of lobes formed on the other end shaped to cradle a golf club shaft therebetween. The body has a watch mechanism mounted therein having a display face and a bezel. The bezel has predetermined markings thereon mounted in the elongated body with the display face opened to the front side thereof. A scoring ring or bezel is rotatably mounted under a front side cover adjacent to and around the timekeeper bezel and is marked for keeping a golf score when rotated relative to the cover and aligning the markings with an aperture in the cover so that a golf tool can keep a golfer's score and time. The body has a snap-on back cover which may also have a ball marker holder formed therein removably supporting a ball marker with a display of an image on the ball marker positioned in a window on the rear of the body or a money or belt clip may be formed on the back cover.

18 Claims, 2 Drawing Sheets

GOLFING ACESSORY APPARATUS

BACKGROUND OF THE INVENTION

The present invention relates to a golf accessory and especially to a golf accessory having a divot tool and a time mechanism with a scoring mechanism thereon.

In playing a game of golf, a golfer frequently has a variety of simple accessories for use on the golf course. These may include accessories such as a divot tool, which may be used for repairing a ball divot and which may be used for cleaning dirt from the grooves of a golf club or sod or other materials caught between the cleats of the golfer's shoes. Many golfers also carry simple golf scoring mechanisms for assisting in keeping score during a golf match. Most golfers also carry a timepiece. In addition, golfers sometime carry a golf ball marker for marking the position of a ball when the golf ball is being cleaned or forming an obstruction to other golfers.

In playing the game of golf, the golfer frequently needs various simple accessories for use on the golf course. The golfer, for instance, needs a divot tool and, in some cases, carries a golf ball marker. The golfer is allowed to lift the golf ball from the surface of a putting green for cleaning of the ball or to keep it from being a distraction or obstruction to other golfers. A lifted ball must, however, be marked to assure that when it is replaced, it will be returned to the same spot from which it was lifted. Not only do the rules of golf permit such ball removal, it is the common practice and courtesy for the golfer to remove and mark the ball and replace it when it becomes his turn to putt. A great variety of specialized ball markers have been suggested and used but a common ball marker being used is a disk about the size of a dime with a peg or prong extending axially from the planar surfaces of the disk shaped body. A golf ball marker can be seen in prior U.S. Pat. No. 5,356,133 dated Oct. 18, 1994.

Frequently, a golfer will be in a position where he needs to put the club he is using down on the turf adjacent to where he is standing. This, however, is not a desired practice inasmuch as the club can get hidden in the grass or can get moisture and dirt on the shaft and handle of the club. The present invention provides a simple golf accessory which can be carried in the pocket of a golfer or in the golf bag and which provides a divot tool having a pair of prongs for insertion in the turf which has a golf club shaft cradle formed on the other end thereof so that when the prongs are pushed in the ground, the golf club can be laid such that the shaft of the club fits in the cradle protruding above the sod to keep the handle and shaft off of the turf. In addition, the accessory of the present invention supports a golf ball marker which is removably attached thereto behind a window where the marker is visible and where a design or logo may be placed for display through the window.

The present divot tool and golf club shaft support and support for a ball marker also provides a timepiece, such as a watch or timer, having a display face thereon, mounted in the body of the tool and incorporating a scorekeeping system. A first bezel has predetermined markings thereon and a rotating scoring bezel rotating around the first bezel and having markings thereon which can be rotated to assist the golfer in keeping score.

In prior U.S. Pat. No. 5,529,299 to Bellagamba, a golf accessory is provided having a divot tool having a removable ball marker attached thereto along with a golf club shaft cradle. The accessory body has a pair of prongs on one end thereof with each prong having a wedge-shaped tip to form a divot tool. The other end of the accessory body has a golf club shaft cradle formed thereon with a pair of lobes forming an arcuate seat therebetween so that the prongs can be pushed into the earth and a golf club shaft laid upon the cradle to keep the shaft off the ground. This patent also provides for a removable ball marker being mounted thereon to display the face of the ball marker through a window on the front side of the body. The present invention is an improvement to this golf accessory.

In the Stowell design patent, No. 318,625, a divot watch is illustrated having prongs that form a divot tool and having the main body of the divot tool having a watch therein. In the Rosen patent, U.S. Pat. No. 5,224,700, a combined putting green repair tool and stop watch has a digital stopwatch mounted in a similar manner to the Stowel patent mounted in a divot tool. In the McDonald patent, U.S. Pat. No. 5,160,134, a combined golf green repair tool and timepiece is illustrated in which a conventional analog watch or timepiece is bolted to the main body of a divot tool having the divot tool prongs extending therefrom. The watch is bolted to the divot tool in a manner that it can be removed from the back for battery replacement and utilizes a wristwatch having insets on each side of the case for clearance for the ends of the wristband. A central portion of the tool also provides holes underlying the insets for a key chain and ball marker retention. In the Hainey patent, U.S. Pat. No. 4,960,278, a golfer's combined divot tool and distance measuring device has a pair of metal prongs along with a disc-shaped handle which includes a spool of very fine string of substantial length fastened to a hook clamp which can be unsnapped from the handle and strung out to measure distances.

The present invention, on the other hand, provides a combination golf tool with a timepiece mounted therein which has a golf scoring mechanism which is integrated into the divot tool and body and watch and is supported from the backside thereof with a back cover which may also include a ball marker holder. The combination tool replaces several golfing accessories carried by golfers in their golf bags or pocket and assures that the golfer will have important accessories needed for the golf course. The body for the accessories are advantageously combined to be removably attached together for ease of production and for repair or replacement of batteries and the like.

SUMMARY OF THE INVENTION

A golf club tool, timepiece, and scoring apparatus has an elongated body having a pair of prongs on one end thereof shaped to form a divot tool and a pair of lobes formed on the other end shaped to cradle a golf club shaft therebetween. The body has a timepiece mechanism mounted therein having a display face and a bezel with predetermined markings thereon rotatably mounted in the elongated body and open to the front side thereof. A scoring ring or bezel is rotatably mounted under a front side of the body around the timepiece bezel and is marked for keeping a golf score when rotated relative to an aperture in the front side for displaying the total score so that a golf tool can keep a golfer's score and time. The body has a back cover which may also have a snap-on ball marker holder formed therein removably supporting a ball marker and which can display an image on the ball marker positioned in a window on the rear of the body.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
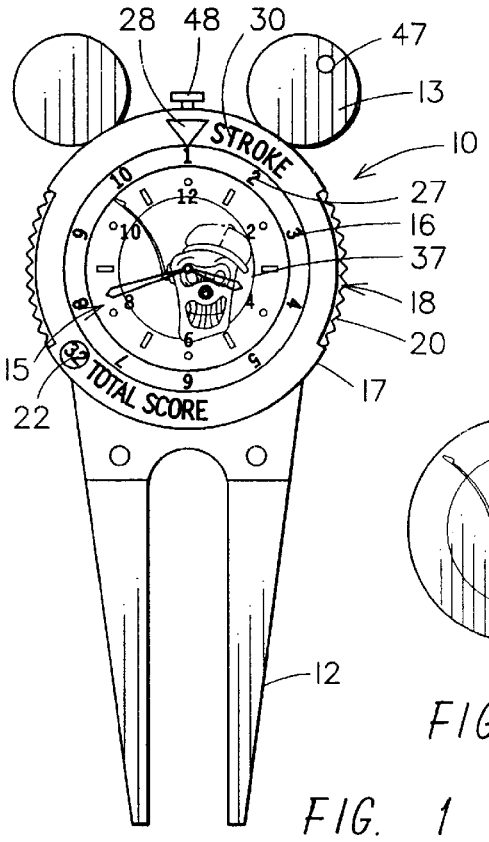
FIG. 1 is a front elevation of a golf accessory in accordance with the present invention.
Figure 7:
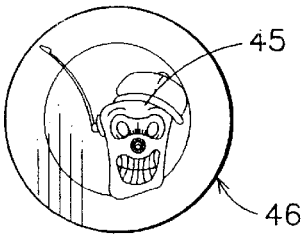
FIG. 7 is a front elevation of the golf ball marker.
Figure 3:
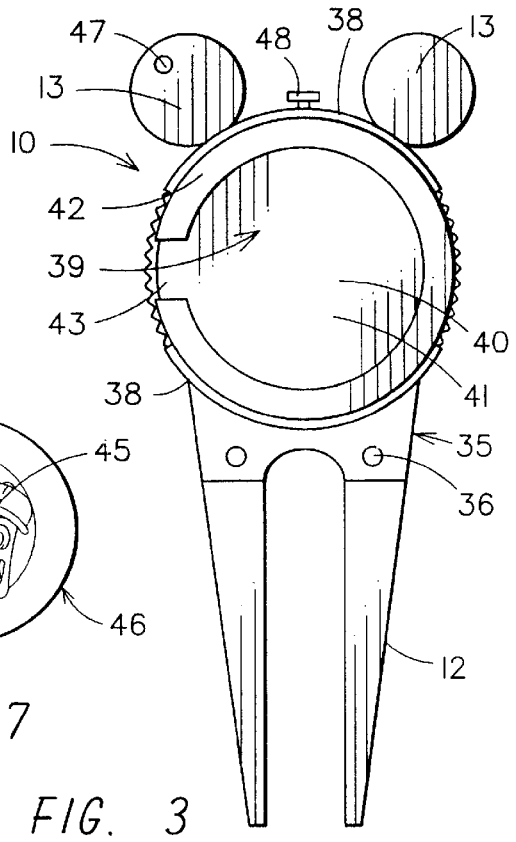
FIG. 3 is a rear elevation of the golf accessory of FIGS. 1 and 2.
Figure 4:
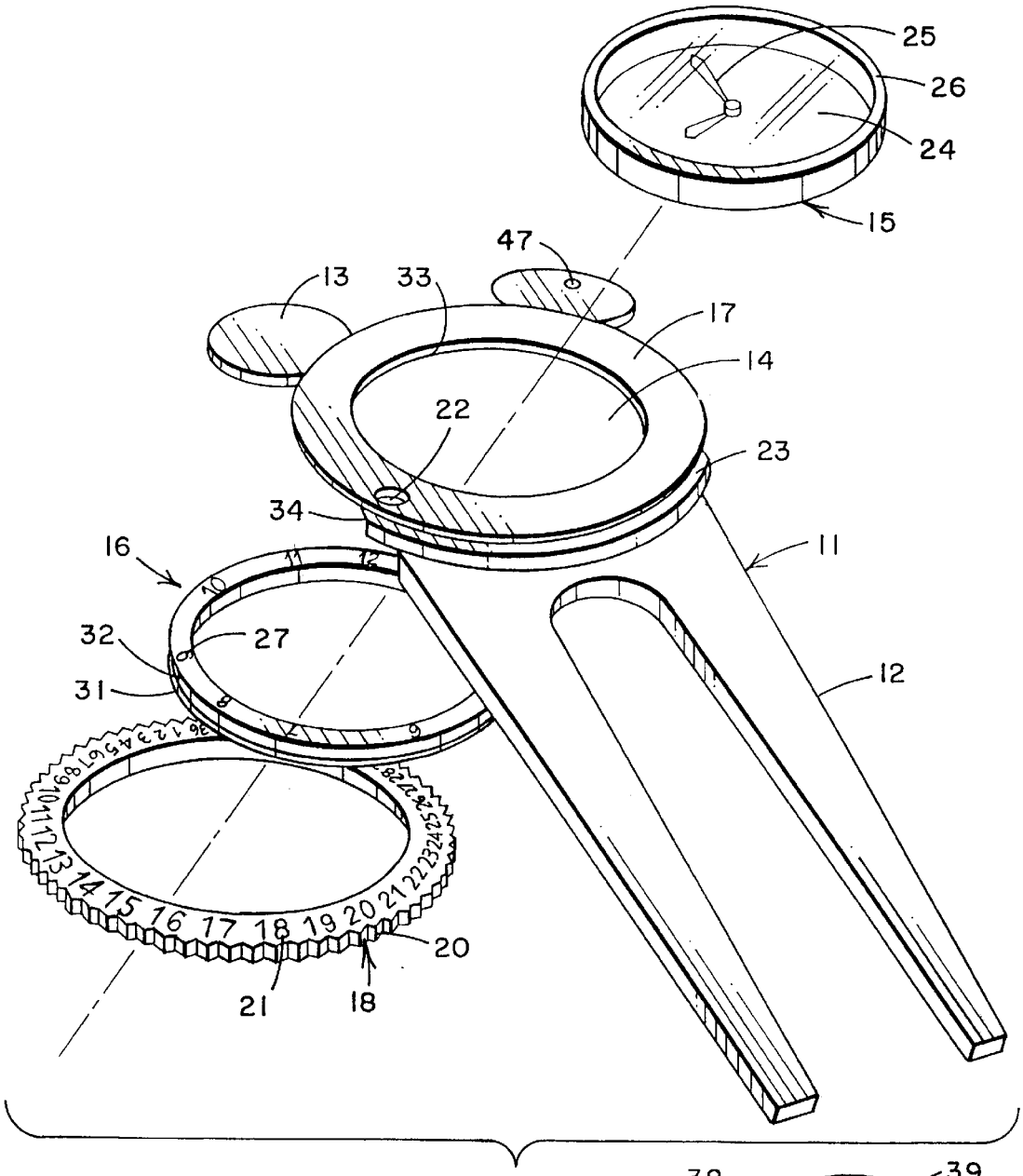
FIG. 4 is an exploded perspective view of the golfing accessory of FIGS. 1–3.
Figure 8:
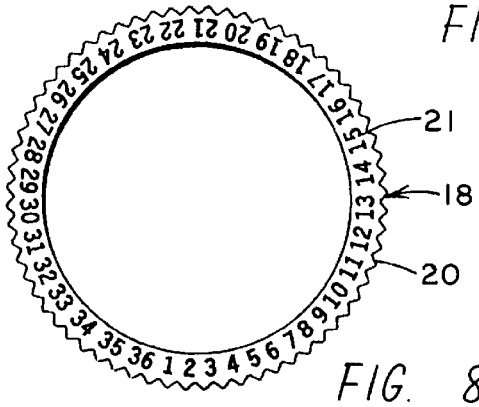
FIG. 8 is a top elevation of a scoring ring for the accessory of FIGS. 1–3.

Referring to the drawings FIGS. 1–8, a golf club tool timepiece and scoring apparatus 10 has a body 11 having a bifurcated pair of prongs 12 on one end thereof to form a divot tool. A pair of generally circular lobes 13 are placed on the opposite end of the body from the divot tool portion 12. The lobes 13 are used to support the shaft of a golf club off the grass by inserting the divot tool end 12 into the turf and laying the handle or shaft of the golf club between the lobes 13. The body 11, as seen in FIG. 4, has an aperture opening 14 extending therethrough for mounting a timepiece or watch 15 along with a bezel 16 which fits around the timepiece 15. Surrounding the opening 14 is a body portion 17 which forms a cover for a scoring bezel or ring 18 having serrated or gripping edges 20 and scoring indicia 21 which may extend from 1–36. The scoring ring cover 17 has a scoring aperture 22 therein and is raised from the divot tool portion 12 by spacing portion 23. The timepiece 15 may have a face 24 and dials 25 and may also have a transparent cover 26 thereover. The timepiece 15 may be analog or digital and is attached inside the bezel 16. Bezel 16 has indicia 27 thereon to indicate the number of golf strokes using pointer 28 which can be aligned with the bezel 16 indicia 27. Pointer 28 is on the scoring ring cover 17 and may have the word "stroke" 30 thereon. The rotation of the bezel to place the stroke number at the arrow 28 indicates the number of golf strokes on any one hole. The bezel 16, as seen in FIG. 4, has an annular ledge 31 therearound which engages the underside of the scoring cover 17 to rotatably hold the bezel within the opening 14 with the periphery portion 32 riding on the surface 33 of the opening 14 and with the timepiece 15 mounted inside the bezel 16 as seen in FIG. 1. The scoring ring or bezel 18 is mounted under the scoring cover 17 so that the indicia 21 can align with the aperture 22 by rotating the scoring bezel. The serrated gripping edges 20 can be seen to extend out the removed portion 34 on either side of the scoring cover 17 in FIG. 1 so that the edges 20 of the scoring bezel 18 can be gripped and rotated to align a total score in the aperture 22. The timepiece and scoring bezel 18 are held to the body 11 with a back piece 35 having a pair of threaded fasteners or screws 36 which are bolted into the back of the body 11 so that the timepiece can be easily removed for replacing batteries or repair. The timepiece 15 has an image 37 thereon which may, for instance indicate a particular golf club or school image.

Figure 6:
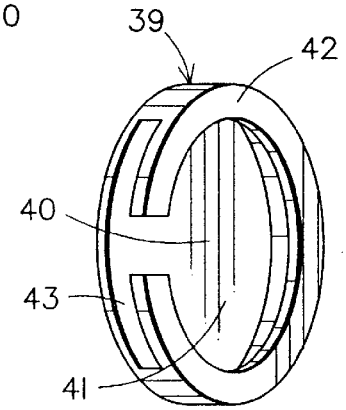
FIG. 6 is a perspective view of a caseback ball marker holder of the golfing accessory of FIGS. 1–3.
Figure 2:
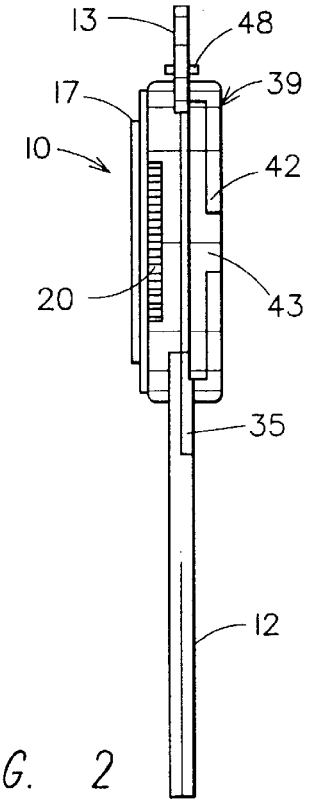
FIG. 2 is a side elevation of the golf accessory tool of FIG. 1.
Figure 5:
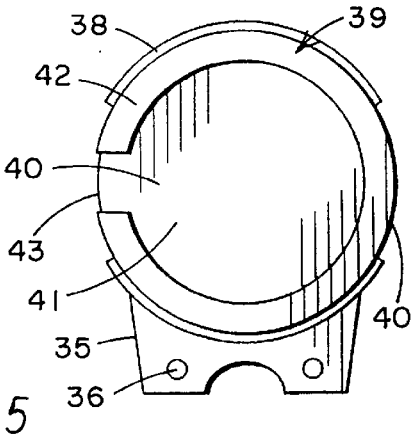
FIG. 5 is a rear elevation of a second embodiment of the caseback of the golfing accessory of FIGS. 1–3.

Referring to FIG. 5, the back 35 can be seen to have a ball mark holder 39 supported in upper and lower arcuate ledges 38. The ball marker holder 37 is of a generally cylindrical shape, as seen in FIGS. 3, 5 and 6, having a base 40 with a front window 41 and surrounded by an annular flange 42 and having a side opening slot 43. A cylindrical or coined shaped ball marker can be slid into the slot 43 for displaying an image 45 on the ball marker 46 of FIG. 7. With the ball mark holder 39 mounted on the back 35 of the body 11, the timepiece or watch 15 as well as the scoring bezel 18 is held in place so that the golf club tool timepiece and scoring apparatus 10 has a display 37 on the watch 15 front side and can have a ball marker 46 supported on the rear side with a display image 45 visible through the open window 41. In addition, the body can have a key chain opening 47, so that keys can be attached to the golf accessory 10. The watch stem 48 can be aligned to protrude from the top of the body 11 between the lobes 13 for adjusting the time on the watch. The stem is positioned such that it is below a golf club shaft or handle placed between the lobes 13.

Figure 9:
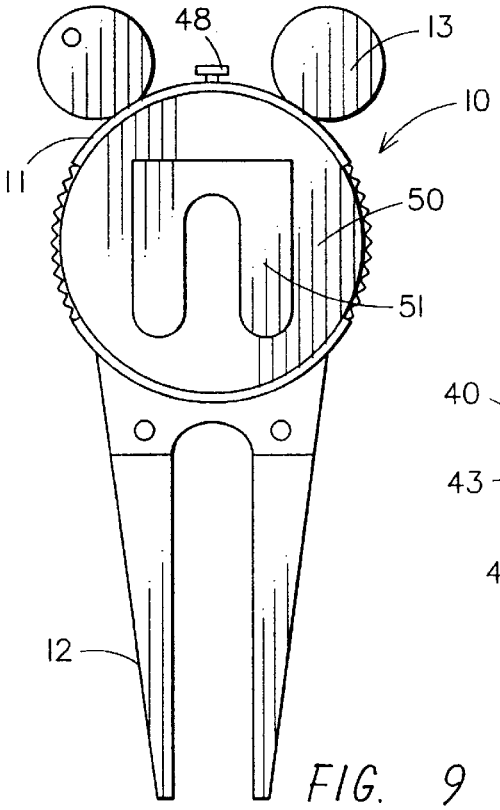
FIG. 9 is an alternate embodiment of a golf accessory having a money clip.

FIG. 9 shows a modified embodiment of the golf accessory 10 having prongs 12, body 11 and lobes 13 and a watch stem 48. A new back piece 50 has a money or belt clip 51 attached thereto for holding paper money or for attaching the golf accessory to a golfer's belt.

It should be clear at this time that a golf accessory has been provided which has a timepiece which can be a watch or timer mounted with a divot tool golf club shaft support and which has an integrated scoring system allowing the golfer to mark each stroke on each hole and then to maintain a total score. The golf accessory also advantageously provides display material on the face of the timepiece as well as allows a ball marker to be removably attached thereto and to display an image thereon. However, it will also be clear that a flat case back can also be utilized without having a ball marker holder thereon to make the overall golf accessory more compact. However, the present invention is not to be limited to the forms shown which are to be considered illustrative rather than restrictive.

I claim:

1. A golf club tool, timepiece and scoring apparatus comprising:

an elongated body having front and back sides and a pair of ends and having a pair of prongs on one said end thereof shaped to form a divot tool, said body also having a pair of lobes formed on the other end thereon shaped to cradle a golf club shaft therebetween and said body having an opening formed between the ends thereof for mounting a timepiece therein, said timepiece opening extending through said body;

a timepiece mechanism having a display face and a bezel therearound having predetermined markings thereon mounted in said elongated body timepiece mounting opening and having the display face open to the front side thereof; and a scoring bezel rotatably mounted to the front side of said body adjacent said one bezel and rotatable therearound and marked for keeping a golf score when rotated on said one bezel, whereby a golf tool can keep a golfer's score and time.

2. A golf club tool, timepiece and scoring apparatus in accordance with claim 1 in which said scoring bezel markings includes numbers from 1 to 36.

3. A golf club tool, timepiece and scoring apparatus in accordance with claim 2 in which said one bezel is marked for number of strokes.

4. A golf club tool, timepiece and scoring apparatus in accordance with claim 3 in which said body has a back cover shaped to cover the back of said watch mounting opening.

5. A golf club tool, timepiece and scoring apparatus in accordance with claim 4 in which said back cover has a ball marker holder formed therein.

6. A golf club tool, timepiece and scoring apparatus in accordance with claim 5 in which said back cover ball marker holder has an edge opening located in one side of said back cover.

7. A golf club tool, timepiece and scoring apparatus in accordance with claim 6 in which said back cover ball marker holder has a window on the back side of said body for displaying a ball marker therein.

8. A golf club tool, timepiece and scoring apparatus in accordance with claim 7 in which said a ball marker has two sides and a predetermined printed image on each side thereof for displaying one of said images in said window on the back side of said body.

9. A golf club tool, timepiece and scoring apparatus in accordance with claim 8 in which said timepiece mechanism has an adjustment stem protruding between the body ear lobes.

10. A golf club tool, timepiece and scoring apparatus in accordance with claim 9 in which said ball marker holder snaps on between supporting lips on the back side of said body.

11. A golf club tool, timepiece and scoring apparatus in accordance with claim 9 in which said body has a bezel cover having an aperture therein formed around the front side of said window to rotatably hold said scoring bezel thereunder and to display one score number on said scoring bezel in said cover aperture.

12. A golf club tool, timepiece and scoring apparatus in accordance with claim 11 in which said scoring bezel has serrated edges protruding from at least one edge of said body bezel cover for gripping and rotating said scoring bezel to thereby keep score by rotating the bezel marking into said cover aperture.

13. A golf club tool, timepiece and scoring apparatus in accordance with claim 12 in which said body includes a timepiece mechanism locking member removably attached on the rear side thereof for removably locking said watch mechanism in said body opening.

14. A golf club tool, timepiece and scoring apparatus in accordance with claim 13 in which said timepiece mechanism locking member is removably attached to said body with threaded fasteners.

15. A golf club tool, timepiece and scoring apparatus in accordance with claim 14 in which said timepiece mechanism has a face having a printed image thereon.

16. A golf club tool, timepiece and scoring apparatus in accordance with claim 1 in which said bezel has an annular lip shaped to rotatably hold said bezel to said body in said body aperture.

17. A golf club tool, timepiece and scoring apparatus in accordance with claim 1 in which said body back side has a belt clip attached thereto.

18. A golf club tool, timepiece and scoring apparatus in accordance with claim 1 in which said body back side has a money clip attached thereto.

* * * * *